United States Patent [19]

Benton

[11] 3,966,294

[45] June 29, 1976

[54] ADAPTOR FOR TRANSFORMER BUSHING TERMINALS

[75] Inventor: Ronald E. Benton, Athens, Ga.

[73] Assignee: Westinghouse Electric Corporation, Pittsburgh, Pa.

[22] Filed: Mar. 5, 1973

[21] Appl. No.: 337,968

[52] U.S. Cl. ..... 339/153; 174/145; 339/272 A

[51] Int. Cl.[2] ..... H01R 15/18

[58] Field of Search ..... 339/153, 202, 272; 174/145

[56] References Cited

UNITED STATES PATENTS 2,597,070 5/1952 Cook et al. ..... 339/272 UC 3,084,305 4/1963 Duenke ..... 339/272 R

*Primary Examiner*—Joseph H. McGlynn

*Attorney, Agent, or Firm*—C. L. McHale

[57] ABSTRACT

An adaptor for attachment to the terminal of a transformer bushing. The adaptor includes a metallic casting having a form-fitting skirt, a connecting stud, a channeled arm, supporting columns, and a crown and base. A knob, shaft and shoe combination is engaged with the casting to provide means for forcing a high-voltage cable against the casting base. In one embodiment, a two-piece, insulating shroud containing knockout regions is positioned around the casting and the bushing terminal.

9 Claims, 9 Drawing Figures

ADAPTOR FOR TRANSFORMER BUSHING TERMINALS

BACKGROUND OF THE INVENTION

1. Field of the Invention:

This invention relates, in general, to electrical inductive apparatus and, more specifically, to adaptors for transformer bushing terminals.

2. Description of the Prior Art:

A large number of terminal arrangements are in use on the bushings of electrical inductive apparatus. The "crowshead" terminal is a widely used arrangement for overhead power distribution transformers. This terminal includes an eye-bolt through which the high-voltage cable is inserted and clamped to the terminal, and a lightning arrester arm which projects laterally from the terminal.

The "spintop" terminal is another widely used arrangement for such bushing terminals. This terminal includes a knob which can be rotated to force a shoe against the high-voltage cable to clamp the cable to the terminal.

In order to change from a crowshead terminal to a spintop terminal, a major change of the bushing has been required according to the prior art. Consequently, distribution transformers having both types of terminals must be manufactured and stocked for sale. Also, utility companies using both types of terminals must maintain transformers with both types of terminals in their replacement inventory of transformers.

Therefore, it is desirable, and it is an object of this invention, to provide a bushing terminal which can be used as a crowshead or spintop terminal with a minimum of effort, either in the factory, in the warehouse, or in the field.

SUMMARY OF THE INVENTION

There is disclosed herein a new and useful adaptor for easily converting crowshead bushing terminals to spintop bushing terminals. The adaptor is slipped over a crowshead terminal and is attached thereto by the eyebolt of the crowshead terminal. With this adaptor, all transformers may be constructed with crowshead bushing terminals. When a spintop terminal is desired, the adaptor is attached to the crowshead terminal.

A primary component of the adaptor is a casting of a metallic conducting material which is formed to have a stud for inserting into the eyebolt of the crowshead terminal. The casting also includes a form-fitting skirt which surrounds part of the crowshead terminal, an arm which fits over the lightning arrester finger of the crowshead terminal, and slots into which the high-voltage cable may be placed. A knob, shaft and shoe combination is engaged with the casting to provide means for clamping the cable to the casting. An insulating, two-piece shroud is positioned around the casting and the crowshead terminal. The shroud contains knockout regions which allow insertion of the high-voltage cable and exposure of the lightning arrester gap finger.

BRIEF DESCRIPTION OF THE DRAWING

Further advantages and uses of this invention will become more apparent when considered in view of the following detailed description and drawing, in which.

DESCRIPTION OF THE PREFFERED EMBODIMENTS

Figure 2:
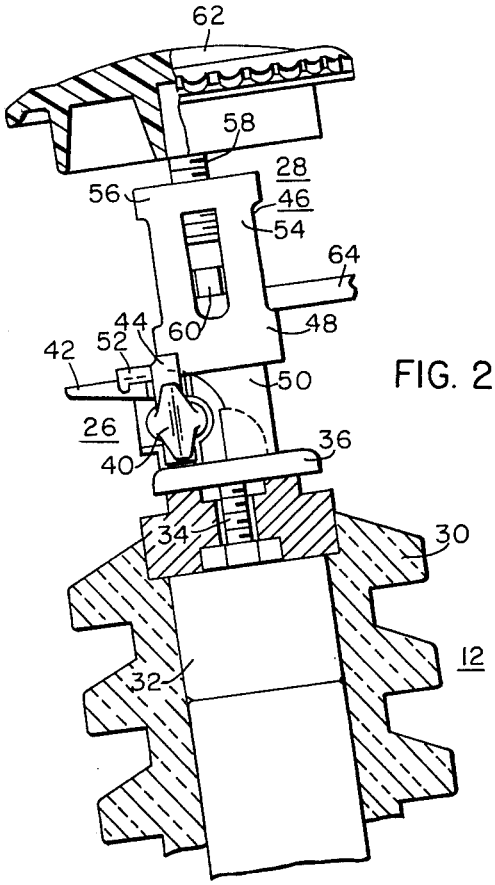
FIG. 2 is a view, partially in section, of a bushing terminal and an adaptor constructed according to this invention.

Throughout the following description, similar reference characters refer to similar elements or members in all the figures of the drawing.

Figure 1:
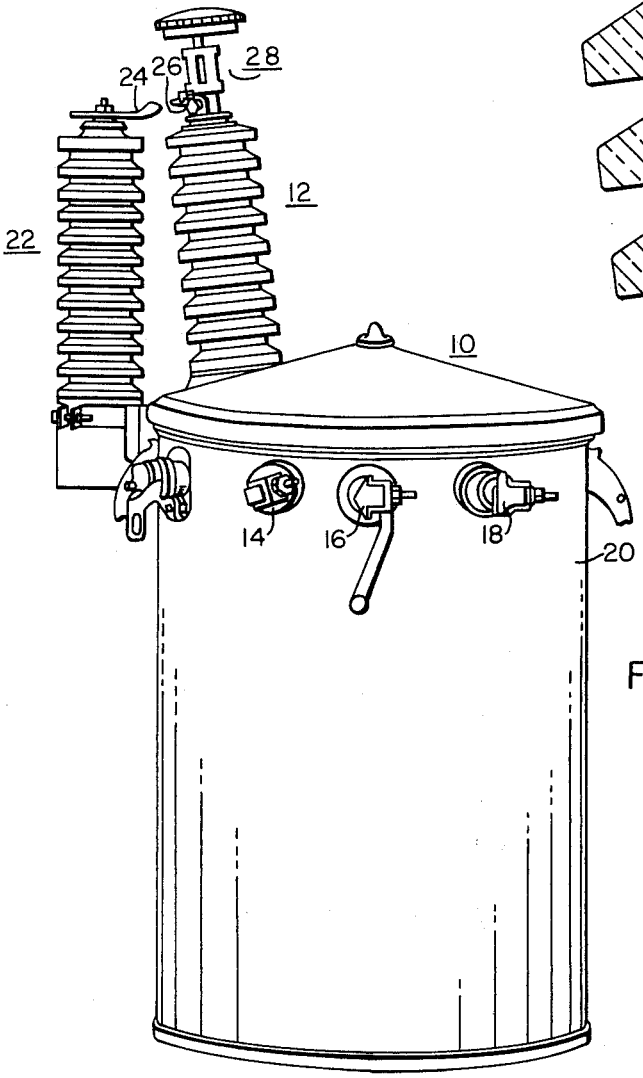
FIG. 1 is a view of an overhead distribution transformer having an adaptor constructed according to this invention attached to a bushing terminal.

Referring now to the drawing, and to FIG. 1 in particular, there is shown a power distribution transformer 10 having a high-voltage bushing 12 and low-voltage bushings 14, 16 and 18 mounted on the transformer tank 20. A lightning arrester 22 having an adjustable arrester probe 24 is also attached to the tank 20.

The bushing 12 includes a crowshead type bushing terminal 26 and a spintop type adaptor 28. The adaptor 28 is attached to the bushing terminal 26 when it is desired to convert a regular crowshead type bushing to a spintop type bushing.

FIG. 2 illustrates the terminal 26 and the adaptor 28 in greater detail. The bushing insulator 30 is constructed of a suitable material, such as porcelain or epoxy. The insulator 30 contains a current limiting member 32 which is in electrical contact with the stud 34 and the metallic terminal cap 36.

The bushing terminal 26 includes a clamping means comprising a conductor seat 38 and an eyebolt 40. The bushing terminal 26 also includes a lightning arrester finger 42. When the adaptor is not being used, the high-voltage cable is inserted through the eyebolt 40 and clamped against the conductor seat 38 by the eyebolt 40.

The adaptor 28 includes a stud 44 which is inserted into the eye of the eyebolt 40 and is tightly clamped to the conductor seat 38. The stud 44 is part of the casting 46 which is constructed of a suitable electrical conducting material, such as an alloy of copper. The stud extends from the base 48 of the adaptor casting 46.

A contour, or form-fitting, skirt 50 is also a part of the casting 46 and extends from the base 48 to fit tightly around a substantial portion of the bushing terminal 26. This helps to secure and position the adaptor 28 to the terminal 26 and to reduce the mechanical stress to which the stud 44 may be subjected. An arm 52 also extends from the base 48 and is also a part of the casting 46. The arm 52 is dimensioned to fit around the arrester finger 42 to prevent rotation of the casting 46 with respect to the terminal 26.

Columns 54 extend from the base 48 and are parts of the casting 46. Columns 54 support the adaptor crown 56 which is a part of the casting 46. The crown 56 contains a threaded opening through which the threaded shaft 58 extends. The shoe 60 is attached to one end of the shaft 58 by a swivel-type joint. A knob 62, which is constructed of a suitable insulating material, is attached to the other end of the shaft 58. When the knob 62 is rotated in the proper direction, shoe 60 is forced toward the base 48 to clamp the cable 64 for proper electrical and mechanical contact with the adaptor 28.

Figure 3:
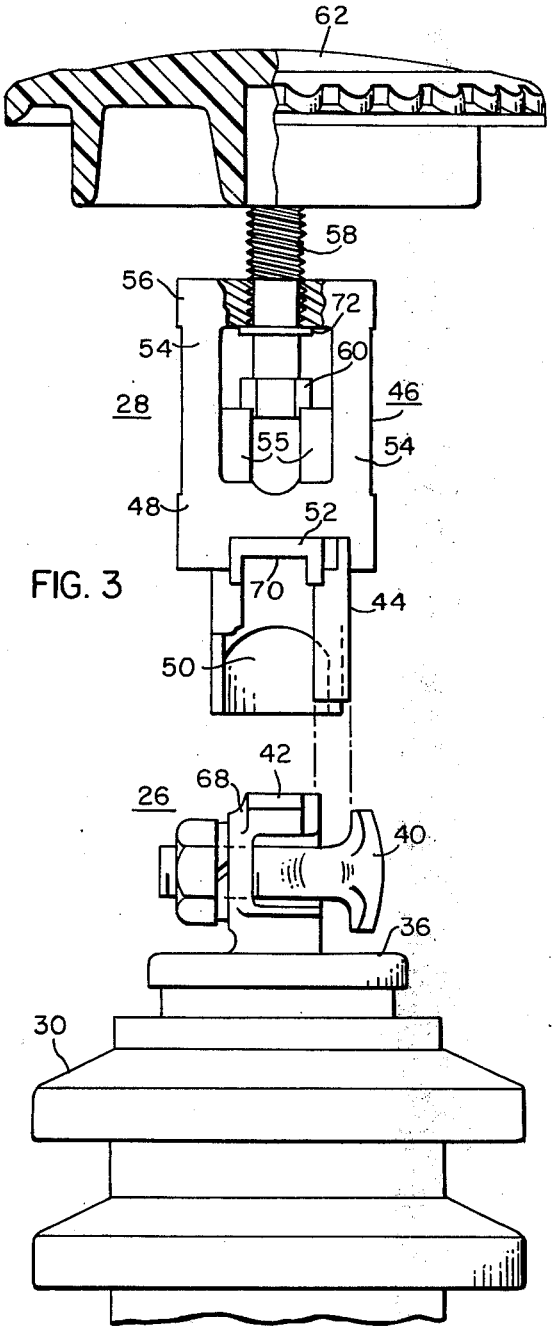
FIG. 3 is a partially exploded view of an adaptor and a bushing terminal.

FIG. 3 is an elevational view of the terminal 26 and the adaptor 28 with the members thereof enlarged to illustrate certain features thereof. The adaptor 28 is shown in disassembled relationship with the terminal 26. The eyebolt 40 extends through an opening in the terminal body 68 and has an eye suitably dimensioned to receive the stud 44. The skirt 50 has a substantially semicircular cross-sectional area with a thickness sufficient to provide the desired mechanical properties. The skirt 50 is shaped to fit closely over the terminal body 68.

The arm 52 contains a channel 70 which is dimensioned to fit closely over the arrester finger 42. The arm 52 and the finger 42 interlock to prevent rotation of the casing 46 with respect to the terminal 26. The columns 54 include inner projections 55 which form a channel within which the shoe 60 moves.

The shoe 60 is attached to the shaft 58 by an arrangement which allows the shoe to swivel. This permits the shaft 58 to rotate without the necessity of rotating the shoe 60. The C-ring 72 is placed around a groove in the shaft 58 to limit the amount of travel of the shaft 58 with respect to the crown 56. The C-ring 72 stops against the crown, as shown in FIG. 3, when the knob 62 has been rotated completely in the unclamping direction. This prevents the disengagement of the shoe 60 with the channel formed by the column projections 55. The unthreaded portion of the shaft 58 permits the knob 62 to "spinfree" when the shoe 60 is fully raised.

Figure 4:
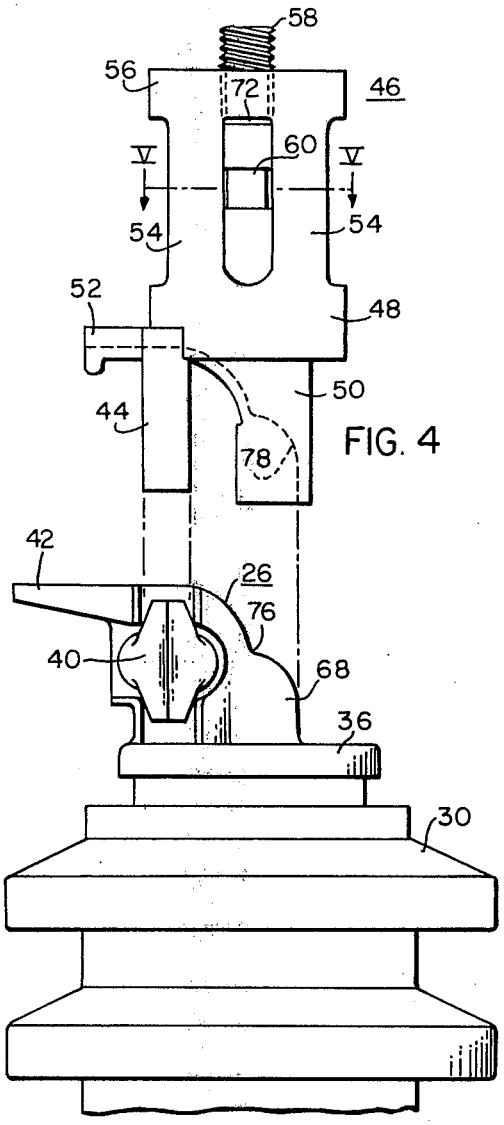
FIG. 4 is a partial view from the side of the elements shown in FIG. 3.

FIG. 4 is a partial side view of the bushing and adaptor 28 shown in FIG. 3. The terminal body 68 includes the shoulder area 76, although it is within the contemplation of this invention that other shapes may be used. The skirt 50 contains a contour surface 78 which is dimensioned to fit closely over the shoulder area 76. Other shapes to make the skirt 50 form-fitting may be used.

Figure 5:
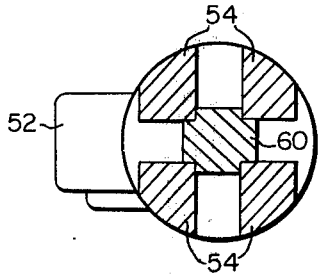
FIG. 5 is a sectional view taken along the line V—V of the casting shown in FIG. 4.

FIG. 5 is a cross-sectional view of the casting 46 taken along the line V—V of FIG. 4. The channel formed by the columns 54 is generally cruciform shaped. The shoe 60 is generally cruciform shaped to prevent rotation of the shoe 60 between the columns 54.

The addition of the adaptor 28 enlarges the area of exposed high-voltage components. To insulate the high voltage from the surroundings, a cover or shroud may be included as part of the adaptor 28. Such a shroud reduces the possibility of electrical faults due to small animals, such as birds and squirrels, which are known to frequently come in contact with the high-voltage components of bushing terminals.

Figure 6:
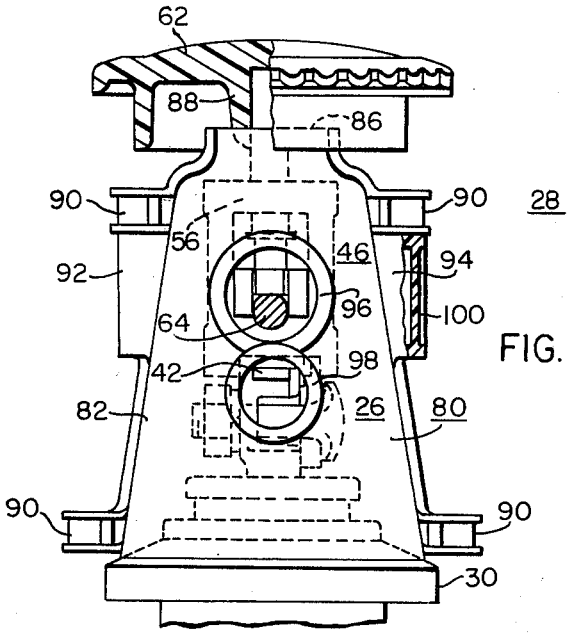
FIG. 6 is an elevational view of an adaptor which includes a shroud.
Figure 7:
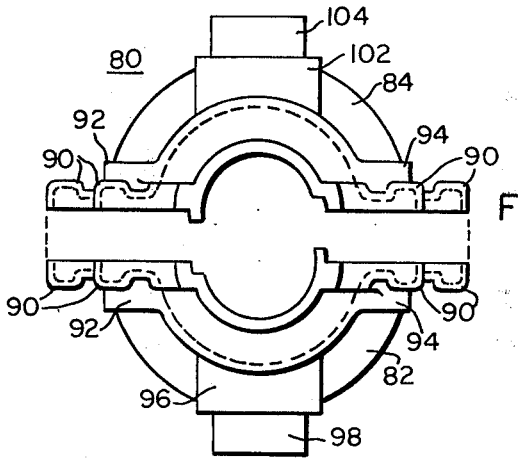
FIG. 7 is a top view of the shroud sections.

FIG. 6 is an elevational view, with portions thereof shown in phantom, illustrating the position of a shroud 80 around the adaptor casting 46 and the bushing terminal 26. The shroud 80 includes two complementary sections, such as section 82. FIG. 7 is top view of the shroud 80 and illustrates complementary sections 82 and 84.

The shroud 80 is constructed of a suitable insulating material, such as a glass reinforced polyester material. As shown in FIG. 6, the shroud 80 is shaped to extend substantially between the crown 56 of the casting 46 and the bushing terminal 26. Opening 86 at the top of the shroud 80 provides the opening necessary for the knob 62 to communicate with the components contained within the shroud 80. The shroud 80 seats on the top of the bushing insulator 30 and is kept in alignment by the knob boss 88 and by the gap finger 42 of the terminal 26.

Clip seats 90 permit the sections of the shroud 80 to be clipped together. Knockout regions are suitably positioned around the shroud 80 to permit the easy formation of the necessary openings in the shroud 80. In FIG. 6, the knockout regions 92 and 94 are closed and the knockout regions 96 and 98 are open. Weakened areas, such as area 100 of knockout 94, are provided for each knockout region to permit the easy opening thereof. These regions are pushed or knocked out when it is desired to place the cable 64 therethrough or for access to the lightning arrester finger 42. Since the cable 64 may be placed into the casting 46 at any one of four positions, four knockout regions are provided on the shroud 80 for cable insertion. As shown in FIG. 7, knockout regions 92, 94, 96 and 102 are provided for insertion of the cable 64. Knockout regions 98 and 104 are provided for acess to the lightning arrester finger 42. Although only one knockout region is required for the arrester finger 42, the construction advantages of using identical complementary sections makes it desirable to provide an extra knockout region in the shroud 80.

Figure 9:
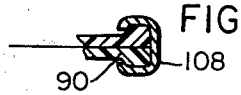
FIG. 9 is a sectional view taken along the line IX—IX of FIG. 8.
Figure 8:
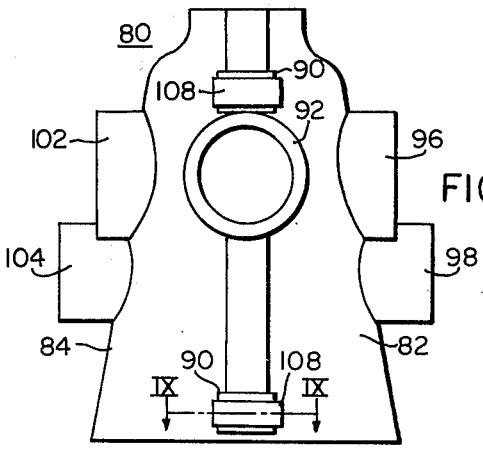
FIG. 8 is a side view of the shroud.

FIG. 8 illustrates a view of the shroud 80 from a side where the sections 82 and 84 are joined. The sections 82 and 84 are attached to each other by C-clips 108. FIG. 9 is a sectional view taken along line IX—IX of FIG. 8 illustrating the position of a C-clip 108 around the clamp seal 90.

Since numerous changes may be made in the above-described apparatus, and since different embodiments of the invention may be made without departing from the spirit thereof, it is intended that all of the matter contained in the foregoing description, or shown in the accompanying drawing, shall be interpreted as illustrative rather than limiting.

I claim as my invention:

1. An adaptor suitable for attachment to the terminal of an electrical bushing, said adaptor comprising:

a form-fitting skirt dimensioned to fit tightly around a substantial portion of the bushing terminal;

a stud dimensioned to extend into clamping means on the bushing terminal;

an adaptor base attached to said skirt and stud;

an adaptor crown having a threaded opening therein;

a plurality of supporting columns having two ends, with one end of said columns attached to said base and the other end of said columns attached to said crown, said columns being separated sufficiently to permit the insertion of an electrical cable between two of said columns;

a shoe disposed between said base and crown and guided within a channel formed by said columns; and tightening means threadably engaged with the threaded opening in said crown, said tightening means being attached to said shoe in such a manner that rotation of said tightening means moves said shoe toward said base.

2. The adaptor of claim 1 wherein an arm having a channel therein is attached to and projects from the adaptor base, with the channel in said arm being dimensioned to fit closely around a lightning arrester finger of the bushing terminal.

3. The adaptor claim 1 wherein the shoe has a cruciform cross-sectional shape, and the channel between the supporting columns in which the shoe is guided is cruciform shaped.

4. The adaptor of claim 1 wherein the tightening means includes a threaded shaft and a knob attached to one end of said threaded shaft, said shaft being threadably engaged with the opening in the adaptor crown, with the shoe being swively attached to the other end of said shaft so that rotating said knob in a first direction screws said shaft through the adaptor crown opening and moves the shoe toward the adaptor base.

5. The adaptor of claim 2 wherein the skirt, the stud, the arm, the adaptor base, the adaptor crown and the supporting columns are integral parts of a single piece of a copper alloy casting material.

6. The adaptor of claim 1 including a shroud suitable for placement substantially between the adaptor crown and the bushing terminal in such a manner as to substantially isolate the electrically conductive members of the adaptor from the adjacent surroundings.

7. The adaptor of claim 6 wherein the shroud comprises two complementary sections constructed of an insulating material, each of said sections having at least one knockout region for inserting a cable through the shroud and under the shoe.

8. The adaptor of claim 6 wherein the shroud includes clip seats suitably dimensioned to permit securing the complementary sections together with clips.

9. An adaptor suitable for attachment to the terminal of an electrical bushing, said adaptor comprising:

an adaptor base constructed of a copper alloy material;

a form-fitting skirt extending from said adaptor base and constructed of said copper alloy material, said skirt being dimensioned to fit tightly around a substantial portion of the bushing terminal;

a stud extending from said adaptor base and constructed of said copper alloy material, said stud being dimensioned to extend into clamping means on the bushing terminal;

an adaptor crown having a threaded opening therein, said crown being constructed of said copper alloy material;

at least four supporting columns constructed of said copper alloy material and extending between said base and crown, said columns being dimensioned and positioned to form a cruciform shaped channel therebetween;

an arm extending from said adaptor base and constructed of said copper alloy material, said arm containing a channel therein which is dimensioned to fit closely around a lightning arrester finger of the bushing terminal;

a knob constructed of an insulating material;

a threaded shaft threadably engaged with the opening in said crown, said knob being connected to one end of said shaft;

a cruciform shaped shoe positioned within the channel between said supporting columns and swively attached to the other end of said shaft;

said shoe being movable toward said base when said knob is rotated in one direction; and first and second complementary shroud sections suitable for placement between the adaptor crown and the bushing terminal in such a manner as to substantially insulate said shaft, shoe, crown, columns, base, arm, skirt, stud and terminal from the adjacent surroundings, each of said shroud sections containing knockout regions suitable for the insertion of an electrical cable and a lightning arrester probe, and each of said shroud sections having clip seats which are dimensioned to permit securing the complementary sections together with clips.

* * * * *